US009406285B2

(12) United States Patent
Soga et al.

(10) Patent No.: US 9,406,285 B2
(45) Date of Patent: Aug. 2, 2016

(54) BOARD FOR STRINGED INSTRUMENT, METHOD OF MANUFACTURING BOARD FOR STRINGED INSTRUMENT, AND STRINGED INSTRUMENT

(71) Applicant: Yamaha Corporation, Hamamatsu-Shi, Shizuoka-Ken (JP)

(72) Inventors: Kazuki Soga, Hamamatsu (JP); Toshihisa Yamazaki, Hamamatsu (JP); Tatsuya Hiraku, Hamamatsu (JP); Hiroshi Nakaya, Hamamatsu (JP); Kenichi Miyazawa, Fukuroi (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 14/518,092

(22) Filed: Oct. 20, 2014

(65) Prior Publication Data

US 2015/0107434 A1 Apr. 23, 2015

(30) Foreign Application Priority Data

Oct. 22, 2013 (JP) ..... 2013-219355

(51) Int. Cl.

| | |
|---|---|
| ***G10D 3/00*** | (2006.01) |
| ***G10D 1/00*** | (2006.01) |
| ***G10D 1/02*** | (2006.01) |
| ***G10D 3/02*** | (2006.01) |

(52) U.S. Cl.

CPC ..... *G10D 1/005* (2013.01); *G10D 1/02* (2013.01); *G10D 3/00* (2013.01); *G10D 3/02* (2013.01); *Y10T 29/49574* (2015.01)

(58) Field of Classification Search

CPC ..... G10D 3/02; G10D 1/02

See application file for complete search history.

(56) References Cited

U.S. PATENT DOCUMENTS

| | | | | | |
|---|---|---|---|---|---|
| 1,377,218 | A | * | 5/1921 | Murdoch | G10C 3/06 84/192 |
| 2,051,633 | A | * | 8/1936 | Bilhuber | G10C 3/06 84/192 |
| 2,070,391 | A | * | 2/1937 | Bilhuber | G10C 3/06 84/192 |
| 2,150,736 | A | * | 3/1939 | Braman | G10D 3/02 84/275 |
| 3,084,586 | A | * | 4/1963 | Westlake | G10D 3/02 84/274 |
| 3,443,466 | A | * | 5/1969 | Brakewell | G10D 3/02 29/462 |
| 3,494,241 | A | * | 2/1970 | Jones, Sr. | G10D 3/02 84/291 |

(Continued)

FOREIGN PATENT DOCUMENTS

| | | |
|---|---|---|
| GB | 1 329 817 | 9/1973 |
| JP | 2011-207159 A | 10/2011 |

OTHER PUBLICATIONS

"The Encyolopedia Violin"; p. 201-203, published by Tokyo Onagaku-sha, issued on Dec. 25, 1992.

*Primary Examiner* — Robert W Horn
(74) *Attorney, Agent, or Firm* — Blank Rome LLP

(57) ABSTRACT

A board for a stringed instrument which forms a front plate or a back plate of a stringed instrument, includes: a veneer that includes a concave portion for partially reducing the thickness of the veneer, in which the veneer is curved to be convex toward one surface side. In this board for a stringed instrument, fiber of the veneer may extend along the curved shape of the veneer.

6 Claims, 3 Drawing Sheets

(56) References Cited

U.S. PATENT DOCUMENTS 3,680,424 A * 8/1972 Delu ..... G10D 3/02 84/274
3,691,891 A * 9/1972 Delu ..... G10D 3/02 84/275
3,722,345 A * 3/1973 Dopera ..... G10D 3/02 29/896.22
4,337,682 A * 7/1982 Schwichtenberg ..... G10C 3/06 84/193
4,348,933 A * 9/1982 Kaman ..... G10C 3/06 84/193
4,941,383 A * 7/1990 Hogue ..... G10D 3/02 84/275
4,955,274 A * 9/1990 Stephens ..... G10D 3/02 84/275
5,585,579 A * 12/1996 Ignatius ..... G10D 3/02 84/192
D380,228 S * 6/1997 Ferguson ..... D17/20
6,177,622 B1 * 1/2001 Green ..... G10D 1/02 84/274
6,410,834 B1 * 6/2002 Hearfield ..... G10G 7/00 84/267
6,610,915 B2 * 8/2003 Schleske ..... G10C 3/06 84/267
6,649,817 B2 * 11/2003 Hartill ..... G09F 7/00 84/267
6,759,581 B2 * 7/2004 Taylor ..... G10D 3/02 84/267
6,852,916 B1 * 2/2005 Burguete ..... G10D 3/02 84/267
7,030,304 B1 * 4/2006 Harris ..... G10D 3/00 84/290
7,141,730 B1 * 11/2006 Wu ..... G10D 1/085 84/267
7,235,728 B2 * 6/2007 Schleske ..... G10D 3/02 84/291
7,507,884 B2 * 3/2009 Carlson ..... B27M 1/003 84/192
7,635,809 B2 * 12/2009 Higgs ..... G10D 1/08 84/327
7,759,566 B2 * 7/2010 Regh ..... G10D 3/02 84/184
8,927,837 B1 * 1/2015 Gallop ..... G10D 3/12 84/299
9,000,282 B1 * 4/2015 Booth ..... G10D 1/08 84/291
2005/0223871 A1 10/2005 Allred
2015/0101473 A1 * 4/2015 Seal ..... G10D 1/08 84/291
2015/0107434 A1 * 4/2015 Soga ..... G10D 1/02 84/291
2015/0107435 A1 * 4/2015 Soga ..... G10D 1/02 84/291

* cited by examiner

BOARD FOR STRINGED INSTRUMENT, METHOD OF MANUFACTURING BOARD FOR STRINGED INSTRUMENT, AND STRINGED INSTRUMENT

BACKGROUND OF THE INVENTION

1. Field of the Invention

The present invention relates to a board for a stringed instrument, a method of manufacturing a board for a stringed instrument, and a stringed instrument.

Priority is claimed on Japanese Patent Application No. 2013-219355, filed on Oct. 22, 2013, the content of which is incorporated herein by reference.

2. Description of Related Art

Front and back plates of a violin have partially different thicknesses so as to obtain satisfactory acoustic characteristics and have a unique camber shape of being gently curved to be convex toward a front or back surface side thereof. Front and back plates used in a viola, a cello, and a double bass belonging to the violin family also have a camber shape having partially different thicknesses as in the case of a violin.

In the related art, during the manufacture of front and back plates of the violin family, a solid wooden block is cut or carved to be formed in a camber shape having partially different thicknesses. However, when a solid wooden block is cut to manufacture front and back plates, there are problems in that time and labor are required due to a significantly large number of cutting processes, and the material yield is extremely low at about 10%.

Recently, as front and back plates of the violin family, plates in which a camber shape having partially different thicknesses is formed by press-bending a board having a smaller thickness than a wooden block to partially compress and curve the board have been manufactured (refer to p. 203, "VIOLIN, Instrument Encyclopedia", published by Tokyo Ongaku-sha).

In addition, front and back plates of the violin family can also be manufactured by laminating a plurality of veneers adhered to each other by an adhesive to obtain laminated wood and bending the laminated wood to be gently curved.

In the front and back plates, since a camber shape is formed by bending, the number of cutting processes for forming the camber shape can be reduced. Accordingly, these front and back plates can be more efficiently manufactured as compared to the plates manufactured by cutting a wooden block, and the material yield is also improved.

However, in the front and back plates formed by press-bending a board, the thicknesses thereof are made to be partially different and a predetermined thickness distribution is formed by partially compressing the board. Therefore, the wood density in the compressed portion increases, and a variation in density is significantly large in the front and back plates. Even if front and back plates of the violin family have a unique camber shape, when a variation in density is large, a vibration during playing is different from the unique vibration of the violin family. Therefore, in a stringed instrument including a front plate and/or a back plate formed by press-bending, satisfactory acoustic characteristics may not be obtained.

In addition, in the front and back plates formed by press-bending, after the manufacture, a thickness distribution and a camber shape thereof are likely to be changed by a restoring force of compressed wood. Therefore, when a stringed instrument including the front and back plates formed by press-bending is used for a long period of time, acoustic characteristics may deteriorate, or there may be a damage caused by deformation of the front plate and/or the back plate.

On the other hand, in the front and back plates in which a camber shape is formed by bending laminated wood, the laminated wood is not partially compressed during the manufacture, and thus a variation in density is small. Accordingly, the above-described problems caused by the density in the front and back plates do not occur.

However, these front and back plates are uniform in thickness. Therefore, in a stringed instrument including these front and back plates, a vibration of the front and back plates during playing is different from the unique vibration of the violin family, and satisfactory acoustic characteristics may not be obtained.

In addition, there may be a case where a camber shape having partially different thicknesses is formed by press-bending laminated wood. However, in this case, since the laminated wood is partially compressed by press-bending, a variation in density is large in the front and back plates.

In addition, there may be a case where a camber shape having partially different thicknesses is formed by cutting laminated wood before or after bending the laminated wood. However, when the laminated wood is cut, a laminated cross-section is exposed to the surface, and a good appearance cannot be obtained.

SUMMARY OF THE INVENTION

The present invention has been made in consideration of the above-described circumstances, and an object thereof is to provide a board for a stringed instrument which can be efficiently manufactured, has high material yield, has a small variation in density, has partially different thicknesses, has a shape of being curved to be convex toward one surface side thereof, and forms a front plate or a back plate having superior shape stability and acoustic characteristics.

In addition, another object of the present invention is to provide a stringed instrument which is not likely to be damaged by deformation of a front plate and/or a back plate and is superior in acoustic quality, the stringed instrument including a front plate and/or a back plate made of a board for a stringed instrument which can be efficiently manufactured and has high material yield.

According to an aspect of the present invention, there is provided a board for a stringed instrument which forms a front plate or a back plate of a stringed instrument, the board including: a veneer that includes a concave portion for partially reducing the thickness of the veneer, in which the veneer is curved to be convex toward one surface side.

According to another aspect of the present invention, there is provided a method of manufacturing a board for a stringed instrument which forms a front plate or a back plate of a stringed instrument, the method including: a process of forming a concave portion on a veneer so as to partially reduce the thickness of the veneer; and a process of curving the veneer to be convex toward one surface side.

According to still another aspect of the present invention, there is provided a stringed instrument including the board for a stringed instrument according to the aspect of the present invention.

In the board for a stringed instrument according to the aspect of the present invention which forms a front plate and a back plate of a stringed instrument, the veneer that includes a concave portion for partially reducing the thickness of the veneer is curved to be convex toward one surface side. Accordingly, in the board for a stringed instrument according to the aspect of the present invention, it is not necessary to partially compress the board in order for the board to have partially different thickness. Therefore, variation in the density of the board for a stringed instrument is small. Accordingly, when the board for a stringed instrument according to the aspect of the present invention is used as a front plate or a back plate, the unique vibration of the violin family is obtained during play, and the acoustic characteristics thereof are superior.

In addition, in the board for a stringed instrument according to the aspect of the present invention, partial compression of the board is not necessary, and thus a thickness distribution and a curved shape are not changed by a restoring force of compressed wood. Accordingly, the board for a stringed instrument according to the aspect of the present invention has superior shape stability as compared to front and back plates of the related art formed by press-bending.

In the board for a stringed instrument according to the aspect of the present invention, the veneer includes a concave portion for partially reducing the thickness of the veneer. In addition, the veneer is curved to be convex toward one surface side. Accordingly, the board for a stringed instrument according to the aspect of the present invention can be manufactured with a small number of cutting or carving processes as compared to the conventional case where the camber shape is formed by cutting or carving. As a result, the board for a stringed instrument according to the aspect of the present invention can be more efficiently manufactured as compared to the plates manufactured by cutting a wooden block, and the material yield is also improved.

The method of manufacturing a board for a stringed instrument according to the aspect of the present invention includes the process of curving the veneer, which includes the concave portion for partially reducing the thickness of the veneer, to be convex toward one surface side. Accordingly, a board for a stringed instrument having partially different thicknesses and a small variation in density can be obtained without partially compressing wood. In addition, in the method of manufacturing a board for a stringed instrument according to the aspect of the present invention, a board for a stringed instrument can be efficiently manufactured with a small number of cutting processes as compared to a case where deformation formed by the veneer being curved is formed by cutting.

In addition, the stringed instrument according to the aspect of the present invention includes the board for a stringed instrument according to the aspect of the present invention. As a result, the acoustic qualities are superior. In addition, the stringed instrument according to the aspect of the present invention is not likely to be damaged by deformation of a front plate and a back plate and thus can be used for a long period of time.

DETAILED DESCRIPTION OF THE INVENTION

Hereinafter, embodiments of the present invention will be described with reference to the drawings.

<First Embodiment>

Figure 1A:
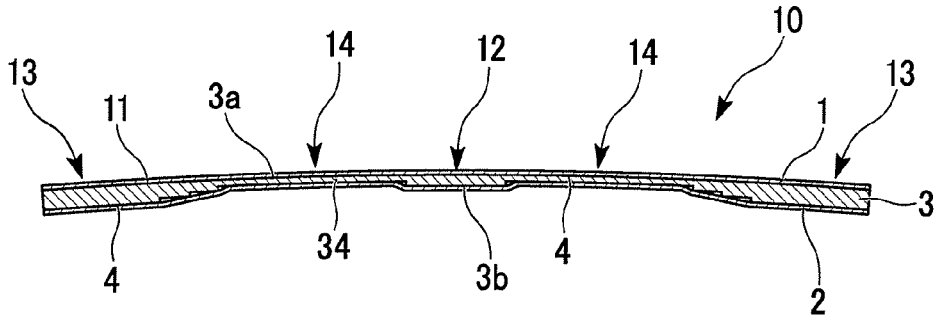
FIG. 1A is a cross-sectional view showing a front plate of a violin according to a first embodiment of the present invention in a width direction thereof (a cross-sectional view taken along line A-A' of FIG. 1B)
Figure 1B:
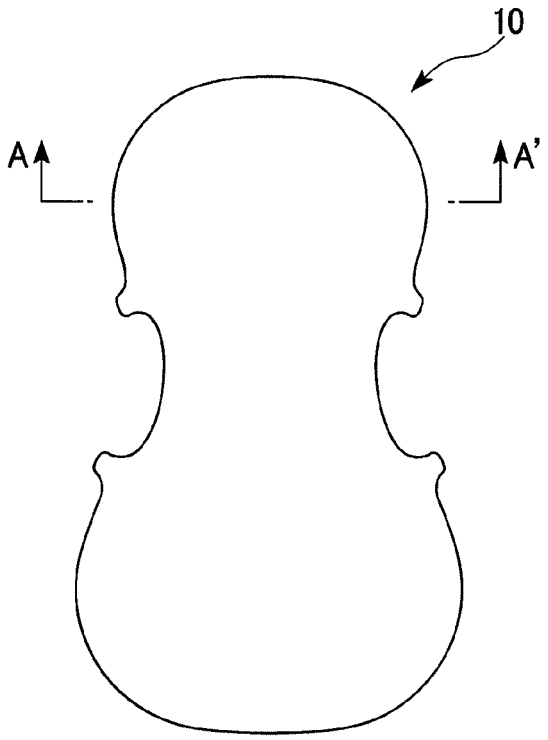
FIG. 1B is a plan view showing the front plate shown in FIG. 1A.

In this embodiment, a front plate of a violin will be described as an example of a board for a stringed instrument according to the present invention. FIG. 1A is a cross-sectional view showing a front plate of a violin according to a first embodiment of the present invention in a width direction thereof. FIG. 1B is a plan view showing the front plate shown in FIG. 1A. FIG. 1A is a cross-sectional view taken along line A-A' of FIG. 1B As shown in FIG. 1A, the front plate 10 of the violin includes a laminated plate 11 which is curved to be convex toward the side of a front surface (top surface in FIG. 1A) and whose thickness gradually changes.

The laminated plate 11 includes a veneer 3 including a concave portion 34. A front surface plate 1 is laminated on a front surface 3*a* of the veneer 3 by an adhesive 4. In addition, a back surface plate 2 is laminated on a back surface 3*b* of the veneer 3 by the adhesive 4. The front surface plate 1 and the back surface plate 2 are made of a veneer having a uniform thickness and function as a decorative sheet which covers the front surface 3*a* or the back surface 3*b* of the veneer 3. In addition, the front surface plate 1 and the back surface plate 2 also have a function of reinforcing the veneer 3 along with the adhesive 4 to prevent deformation of the veneer 3.

In the front plate 10 shown in FIG. 1A, the veneer 3 is curved such that fiber of the veneer 3 extends along the curved shape of the veneer 3.

On the back surface 3*b* (bottom surface of the veneer 3 in FIG. 1A), a concave portion 34 in which the depth of the bottom surface varies stepwise is formed. The concave portion 34 allows the thickness of the veneer 3 to be partially reduced and has a predetermined shape and a predetermined depth distribution in consideration of a function of the front plate 10 as a vibrating plate.

Regarding the thickness of the veneer 3, as shown in FIG. 1A, the thickness of peripheral edges 13 which are positioned outside the concave portion 34 in a plan view is the thickest. In addition, regarding the thickness of the veneer 3, the thickness of thin portions 14 which are positioned between the peripheral edges 13 and a center portion 12 thinner than the peripheral edges 13 is the thinnest. As shown in FIG. 1, the thickness of the veneer 3 decreases stepwise from the peripheral edges 13 toward the thin portions 14 and increases from the thin portions 14 to the center portion 12.

The thickness distribution of the veneer is determined according to performance required for a front plate or a back plate of a violin and is not limited to the thickness distribution of the veneer 3 shown in FIG. 1A. For example, a configuration in which the peripheral edges are thin and the center portion is thick may be adopted.

Examples of the materials of the veneer 3, the front surface plate 1, and the back surface plate 2 include spruce, maple, pine, Japanese cedar, birch, beech, or lauan. Among these, spruce is preferably used because a high function of the front plate 10 as a vibrating plate can be obtained.

All the materials of the veneer 3, the front surface plate 1, and the back surface plate 2 may be the same, or all or a part of the materials may be different. In the embodiment, all of the veneer 3, the front surface plate 1, and the back surface plate 2 are made of spruce. As a result, a higher function as the front plate 10 can be obtained, and the acoustic quality of a violin using this front plate 10 can be further improved.

In the front plate 10 according to the embodiment, the front surface plate 1 is made of straight-grained spruce, and a fiber direction thereof is aligned to a length direction of the front plate 10 in plan view. As a result, a better appearance can be obtained. In addition, the front surface plate 1 of the front plate 10 has a continuous plane which is integrated by aligning end surfaces of two veneers to face each other at a center portion in a length direction of the front plate 10 and joining the end surfaces to each other. As a result, a good appearance having a joint at the center portion in the length direction of the front plate 10 is obtained.

In the front plate 10 shown in FIG. 1A, the thicknesses of the front surface plate 1 and the back surface plate 2 are preferably 0.2 mm to 1.0 mm. The thicknesses of the front surface plate 1 and the back surface plate 2 may be the same as or different from each other. When the thicknesses of the front surface plate 1 and the back surface plate 2 are 0.2 mm or more, a function of coating the front surface of veneer 3 as a decorative sheet can be obtained, and a better appearance can be obtained. In addition, when the thicknesses of the front surface plate 1 and the back surface plate 2 are 0.2 mm or more, the front surface plate 1 and the back surface plate 2 can obtain a function of reinforcing the veneer 3 along with the adhesive 4 to prevent deformation of the veneer 3 and can improve the shape stability of the front plate 10. In addition, when the thicknesses of the front surface plate 1 and the back surface plate 2 are 1.0 mm or less, the thickness of the veneer 3 can be sufficiently secured, and a thickness range of the front plate 10 which can be adjusted by the depth distribution of the concave portion 34 can be sufficiently secured.

The thickness of the front surface plate 1 is more preferably 0.3 mm or more. In this case, a cutting stock of the front surface of the laminated plate 11 can be sufficiently secured. Accordingly, even if the thickness distribution of the front plate 10 is finely adjusted or convex and concave portions present on the front surface of the front plate 10 are removed by cutting the front surface of the laminated plate 11 using, for example, a scraper, the front surface of the veneer 3 can be prevented from being exposed. In addition, the thickness of the front surface plate 1 is preferably 0.3 mm or more because a step which is formed by the concave portion 34 formed on the veneer 3 can be prevented from being taken over to front surface of the front plate 10 to form a convex portion.

As the adhesive 4, one not containing a solvent such as water or an organic solvent is preferably used. Specifically, examples of the adhesive 4 not containing a solvent include a urethane-based adhesive, an epoxy-based adhesive, and a phenol-based adhesive. By using the adhesive not containing a solvent as the adhesive 4, deformation of the front surface plate 1 and/or the back surface plate 2 caused by infiltration of an adhesive 4 into the front surface plate 1 and/or the back surface plate 2 can be prevented during the manufacture of the laminated plate 11. Accordingly, the thickness distribution of the laminated plate 11 can be controlled with higher accuracy.

(Manufacturing Method)

In this embodiment, a method of manufacturing the front plate of the violin shown in FIGS. 1A and 1B will be described as an example of a method of manufacturing a board for a stringed instrument according to the present invention.

In order to manufacture the front plate 10 shown in FIGS. 1A and 1B, first, the veneer 3 (refer to FIG. 2) including the concave portion 34 is prepared. Next, the front surface plate 1, the veneer 3, and the back surface plate 2 are laminated in this order from below through the adhesive 4 to form a laminate 10*a* shown in FIG. 3.

Figure 2:
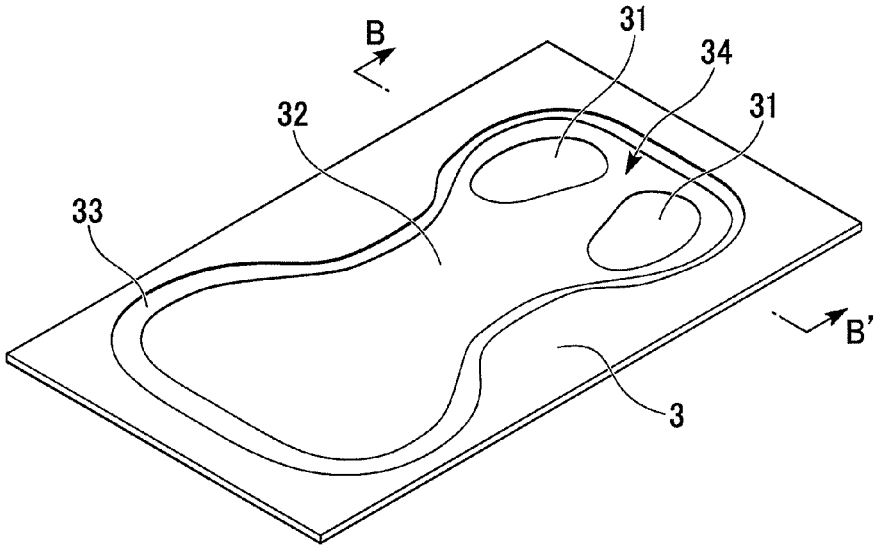
FIG. 2 is a perspective view showing a shape of a veneer used in the front plate shown in FIGS. 1A and 1B.
Figure 3:
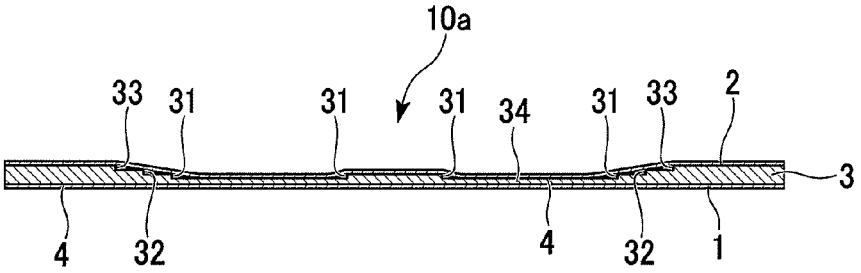
FIG. 3 is a cross-sectional view showing a laminated plate which is formed when the front plate shown in FIGS. 1A and 1B is manufactured.

FIG. 2 is a perspective view showing a shape of a veneer used in the front plate shown in FIGS. 1A and 1B. FIG. 3 is a cross-sectional view showing a laminated plate which is formed when the front plate shown in FIGS. 1A and 1B is manufactured. FIG. 3 is a cross-sectional view taken along line B-B' of FIG. 2.

The veneer 3 shown in FIG. 2 is larger than the external shape of the front plate 10 shown in FIG. 1B. On the veneer 3, the concave portion 34 for partially reducing the thickness of the veneer 3 is formed. In the concave portion 34, the depth of the bottom surface varies stepwise as shown in FIGS. 2 and 3. The concave portion 34 can be formed using, for example, a method of cutting a veneer, which is to form the veneer 3, to obtain a predetermined depth and a predetermined planar shape.

On the bottom surface of the concave portion 34, as shown in FIGS. 2 and 3, a first bottom surface 31, a second bottom surface 32, and a third bottom surface 33 which have different depths are formed. The first bottom surface 31, the second bottom surface 32, and the third bottom surface 33 are flat, and a step is formed at a boundary portion of each bottom surface. The first bottom surface 31 having the deepest depth is provided in a region where the concave portion 34 overlaps with the thin portions 14 of the front plate 10 shown in FIG. 1A in a plan view. In addition, the second bottom surface 32 having the second deepest depth subsequent to the first bottom surface 31 is provided in a region where the concave portion 34 overlaps with the thin portions 14 and the center portion 12 in plan view. In addition, the third bottom surface 33 having the shallowest depth is provided so as to surround the outer edge of the second bottom surface 32.

When the front surface plate 1, the veneer 3, and the back surface plate 2 are laminated to form the laminate 10*a* shown FIG. 3, fiber directions of the front surface plate 1, the veneer 3, and the back surface plate 2 may be the same as or different from each other. It is preferable that the fiber directions of the front surface plate 1, the veneer 3, and the back surface plate 2 be aligned to the length direction of the front plate 10 in consideration of a function of the front plate 10 as a vibrating plate. In particular, in consideration of a function of the front plate 10 as a vibrating plate, it is preferable that the veneer 3 be made of straight-grained wood and arranged such that the fiber direction of the veneer 3 is aligned to the length direction of the front plate 10. It is preferable that the fiber direction of the front surface plate 1 be aligned to the length direction of the front plate 10 in consideration of the appearance of the front plate 10.

In addition, a part of the fiber directions of the front surface plate 1, the veneer 3, and the back surface plate 2, for example, a fiber direction of the back surface plate 2 may be aligned to the width direction of the front plate 10 in consideration of the strength and shape stability of the front plate 10.

As the adhesive 4, as described above, an adhesive not containing a solvent such as a urethane-based adhesive, an epoxy-based adhesive, or a phenol-based adhesive is preferably used. As the adhesive 4, a thermal adhesive sheet may also be used.

Next, the laminate 10*a* shown in FIG. 3 is curved to be convex toward one surface side. In the embodiment, the laminate 10*a* shown in FIG. 3 is curved by placing the laminate 10*a* into a cavity of a metal mold and bending the laminate 10*a*. As the metal mold, one in which an inside shape of the cavity corresponds to the cross-sectional shape of the front plate 10 is used. By bending the laminate 10*a* including the veneer 3 in which the concave portion 34 is formed using the above metal mold, the laminated plate 11 having a camber shape which has a small variation in density, has partially different thicknesses, and is curved to be convex toward one surface side can be obtained.

It is preferable that the bending process be performed under a condition where a compressive stress is not applied to the front surface plate 1, the veneer 3, and the back surface plate 2. Accordingly, the laminated plate 11 has a uniform density similar to the intrinsic density of wood which forms the front surface plate 1, the veneer 3, and the back surface plate 2. As a result, deformation of the manufactured front plate 10 can be further suppressed, and the front plate 10 can obtain superior acoustic characteristics intrinsic to wood.

In addition, a temperature condition of the bending process is not particularly limited and can be appropriately determined according to the kind of the adhesive 4 to be used. For example, when a thermoset adhesive is used as the adhesive 4, it is preferable that the adhesive 4 be cured during the bending process by performing the bending process while performing a heat treatment to a predetermined temperature.

Next, the curved laminated plate 11 is cut using, for example, a saw along a visible outline (not shown) of the front plate 10 which is positioned outside the contour of the concave portion 34 of the veneer 3 in a plan view, thereby obtaining the front plate 10 having a predetermined external shape shown in FIG. 1B.

Next, optionally, a finishing process may be performed in which the thickness distribution of the front plate 10 is finely adjusted or convex and concave portions present on the front surface of the front plate 10 are removed by cutting the front surface of the laminated plate 11 using, for example, a scraper.

Through the above-described processes, the front plate 10 shown in FIGS. 1A and 1B is obtained.

In addition, in the front plate 10 shown in FIG. 1A, the veneer 3 that includes the concave portion 34 for partially reducing the thickness of the veneer 3 is curved to be convex toward one surface side. Accordingly, it is not necessary to partially compress wood in order for the wood to have partially different thickness. Therefore, a variation in density is small in the front plate 10. Accordingly, when a violin including the front plate 10 shown in FIG. 1A is played, the unique vibration of the violin family can be obtained, and superior acoustic characteristics can be obtained.

In the front plate 10 shown in FIG. 1A, it is not necessary to partially compress the wood. Therefore, a thickness distribution and a curved shape are not changed by a restoring force of compressed wood. Therefore, the front plate 10 shown in FIG. 1A has superior shape stability as compared to front and back plates of the related art formed by press-bending.

Further, in the front plate 10 shown in FIG. 1A, the front surface plate 1, the veneer 3, and the back surface plate 2 are laminated and fixed through the adhesive 4. Therefore, deformation of the front plate 10 is suppressed.

In addition, in the front plate 10 shown in FIG. 1A, the veneer 3 including the concave portion 34 is curved to be convex toward one surface side. Accordingly, the front plate 10 shown in FIG. 1A can be manufactured with a small number of cutting processes as compared to a case where deformation formed by the veneer 3 being curved is formed by cutting or carving. Accordingly, the front plate 10 shown in FIG. 1A can be more efficiently manufactured as compared to the plates manufactured by cutting a wooden block, and the material yield is also improved.

In the front plate 10 shown in FIG. 1A, the front surface plate 1 as a decorative sheet is laminated on one surface of the veneer 3 by the adhesive 4. Accordingly, by using a material having superior design characteristic as a material of the front surface plate 1, a good appearance can be obtained.

The method of manufacturing the front plate 10 shown in FIG. 1A includes the process of curving the veneer, which includes the concave portion 34 for partially reducing the thickness of the veneer, to be convex toward one surface side. Accordingly, the front plate 10 having partially different thicknesses and a small variation in density can be obtained without partially compressing wood. In addition, in the method of manufacturing the front plate 10 shown in FIG. 1A, a board for a stringed instrument can be efficiently manufactured with a small number of cutting processes as compared to a case where deformation formed by the veneer being curved is formed by cutting.

<Second Embodiment>

In this embodiment, a back plate of a violin will be described as an example of a board for a stringed instrument according to the present invention.

The back plate of the violin according to the embodiment is different from the front plate 10 according to the first embodiment shown in FIG. 1A, in that: the depth distribution and shape of the concave portion of the veneer are determined according to a thickness distribution in consideration of a function as the back plate. Further, in the second embodiment, veneers which are to form the front surface plate, the back surface plate, and the veneer are made of maple.

In the back plate according to the embodiment, it is more preferable that all of the front surface plate, the back surface plate, and the veneer be made of maple. By allowing all the front surface plate, the back surface plate, and the veneer to be made of maple, a higher function as the back plate can be obtained, and the acoustic quality of a violin using this back plate can be further improved. In addition, in the back plate according to the embodiment, a better appearance can be obtained by using maple having grain as the materials of the veneers which form the front surface plate.

The back plate of the violin according to the embodiment can be manufactured with the same method as the front plate 10 according to the above-described first embodiment.

In addition, with the back plate according to the embodiment, the same effects as the front plate 10 according to the above-described first embodiment can be obtained. That is, the back plate according to the embodiment can be efficiently manufactured and has high material yield. Accordingly, the back plate according to the embodiment has a small variation in density, has partially different thicknesses, has a shape of being curved to be convex toward one surface side, superior shape stability, a good appearance, and superior acoustic characteristics.

<Stringed Instrument>

Figure 4:
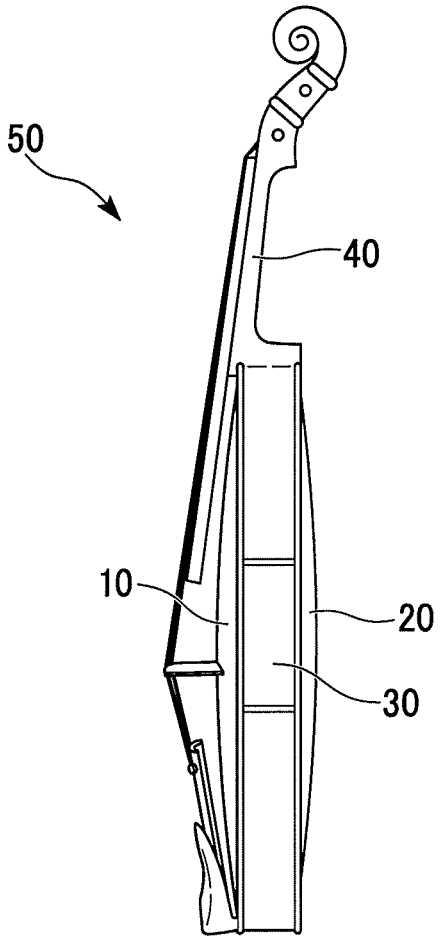
FIG. 4 is a side view showing a violin which is an example of a stringed instrument according to the present invention.

In this embodiment, a violin will be described as an example of a stringed instrument according to the present invention. FIG. 4 is a side view showing a violin which is an example of the stringed instrument according to the present invention.

In FIG. 4, the violin 50 includes a front plate 10, a back plate 20, a side plate 30, and a neck 40.

In the violin 50 shown in FIG. 4, the front plate according to the first embodiment is used as the front plate 10. In the front plate 10 shown in FIG. 4, a f-hole (not shown) is formed at a predetermined position of the front plate 10 according to the first embodiment.

In the violin 50 shown in FIG. 4, the back plate according to the second embodiment is used as the back plate 20.

The violin 50 can be manufactured with a well-known method of the related art by using the front plate according to the first embodiment as the front plate 10 and using the back plate according to the second embodiment as the back plate 20.

Specifically, for example, the back plate 20 and the side plate 30 are bonded to each other using an adhesive such as glue. Next, the side plate 30 and the front plate 10 are bonded to each other using an adhesive such as glue to form a body. Next, the neck 40 is attached to the body, and the front surface is coated with varnish. Next, a fingerboard is attached, and a sound post is installed. Next, a bridge is installed, and strings are tensed.

Through the above-described processes, the violin 50 shown in FIG. 4 is obtained.

The violin 50 can be manufactured by using the front plate according to the first embodiment as the front plate 10 and using the back plate according to the second embodiment as the back plate 20, and thus has a good appearance and is superior in acoustic qualities. In addition, the violin 50 is not likely to be damaged by deformation of the front plate 10 and the back plate 20 and thus can be used for a long period of time.

<Other Examples>

The stringed instrument and the board for a stringed instrument according to the present invention are not limited to the above-described embodiments.

For example, the stringed instrument according to the present invention is not limited to a violin and may be a viola, a cello, or a double base belonging to the violin family. In addition, the present invention can also be applied to a stringed instrument, such as a guitar or the like, including a front plate and/or a back plate having a camber shape which is curved to be convex toward one surface side.

In the above-described example of the embodiments, the bottom surfaces having different depths are formed in three steps as the bottom surface of the concave portion of the veneer. However, the bottom surface may be a continuous curved shape. In addition, the number of depth steps of bottom surfaces having different depths is not particularly limited may be two, three as in the case of the above-described embodiments, or four or more.

In addition, in the above-described embodiment, a step is formed at the boundary portion between the bottom surfaces having different depths. However, an inclined surface for alleviating the step may be formed at the boundary portion between the bottom surfaces.

In addition, in the front plate 10 shown in FIG. 1A, the concave portion 34 of the veneer 3 is formed on one surface of the veneer 3. However, the concave portion may be formed on both surfaces of the veneer. In addition, a plurality of concave portions may be formed.

In addition, in the above-described example, the front plate 10 shown in FIG. 1A includes the front surface plate 1 and the back surface plate 2. However, the front surface plate 1 and/or the back surface plate 2 are not necessarily provided. In addition, two or more front surface plates 1 and/or two or more back surface plate 2 may be provided.

When a board for a stringed instrument is a front plate not including a front surface plate, it is preferable that the veneer be made of straight-grained spruce in order to obtain a better appearance and high acoustic quality. When a board for a stringed instrument is a back plate not including a front surface plate, it is preferable that the veneer be made of maple having grain in order to obtain a better appearance and high acoustic quality.

In addition, when a front surface plate is not provided, the veneer may have a continuous plane which is integrated by aligning end surfaces of two veneers to face each other at a center portion in a length direction of a front plate or a back plate and joining the end surfaces to each other.

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A board for a stringed instrument which forms a front plate or a back plate of a stringed instrument, the board comprising:

a veneer that includes a concave portion for partially reducing the thickness of the veneer; and a plate that is laminated on the veneer and covers the concave portion, wherein the veneer is curved to be convex toward one surface side.

2. The board for a stringed instrument according to claim 1, wherein fiber of the veneer extends along the curved shape of the veneer.

3. The board for a stringed instrument according to claim 1, wherein a decorative sheet is laminated on one surface or both surfaces of the veneer by an adhesive.

4. A method of manufacturing a board for a stringed instrument which forms a front plate or a back plate of a stringed instrument, the method comprising:

a process of forming a concave portion on a veneer so as to partially reduce the thickness of the veneer;

a process of laminating a plate on the veneer so as to cover the concave portion; and a process of curving the veneer to be convex toward one surface side.

5. The method of manufacturing a board for a stringed instrument according to claim 4, further comprising: a laminating process of laminating a decorative sheet on one surface or both surfaces of the veneer by an adhesive, wherein the process of curving the veneer to be convex toward one surface side is performed after the laminating process.

6. A stringed instrument comprising: the board for a stringed instrument according to claim 1.

* * * * *